US009410344B2

(12) United States Patent
Stacey et al.

(10) Patent No.: US 9,410,344 B2
(45) Date of Patent: Aug. 9, 2016

(54) PROTECTIVE CASE FOR PHYSICALLY SECURING A PORTABLE ELECTRONIC DEVICE

(75) Inventors: Jonathan Stacey, Vancouver (CA); Jonathan Corpuz, Fremont, CA (US); Dominic Peralta, San Mateo, CA (US); Stephen Myers, Redwood City, CA (US)

(73) Assignee: ACCO Brands Corporation, Lake Zurich, IL (US)

( * ) Notice: Subject to any disclaimer, the term of this patent is extended or adjusted under 35 U.S.C. 154(b) by 637 days.

(21) Appl. No.: 13/450,817

(22) Filed: Apr. 19, 2012

(65) Prior Publication Data

US 2012/0318711 A1 Dec. 20, 2012

Related U.S. Application Data

(60) Provisional application No. 61/496,983, filed on Jun. 14, 2011.

(51) Int. Cl.
*E05B 69/00* (2006.01)
*E05B 73/00* (2006.01)

(52) U.S. Cl.
CPC ..... *E05B 73/0082* (2013.01); *E05B 73/0005* (2013.01); *Y10T 29/49947* (2015.01)

(58) Field of Classification Search
CPC . E05B 73/00; E05B 73/0017; E05B 73/0023; E05B 73/0082; E05B 67/00; E05B 67/06; E05B 67/24
USPC ..... 70/57, 57.1, 58, 63
See application file for complete search history.

(56) References Cited

U.S. PATENT DOCUMENTS

| | | | | |
|---|---|---|---|---|
| 2,460,474 | A * | 2/1949 | Soref | E05B 67/24 70/367 |
| 2,489,484 | A * | 11/1949 | Dyson | E05B 67/24 70/370 |
| 2,673,458 | A * | 3/1954 | Schlage | E05B 67/24 70/370 |
| 4,005,279 | A | 1/1977 | Richter | |
| 4,252,007 | A | 2/1981 | Kerley | |
| 4,471,409 | A | 9/1984 | Dittrich | |
| 4,667,491 | A | 5/1987 | Lokken et al. | |
| 4,884,420 | A | 12/1989 | Finkel et al. | |

(Continued)

FOREIGN PATENT DOCUMENTS

DE 20 2010 011 923 U1 1/2011

OTHER PUBLICATIONS

International Search Report and Written Opinion of PCT/US2012/039414 mailed on Aug. 7, 2012, 8 pages.

(Continued)

*Primary Examiner* — Christopher Boswell
(74) *Attorney, Agent, or Firm* — Michael Best & Friedrich LLP

(57) ABSTRACT

In some embodiments of the invention, a security apparatus for a portable electronic device is provided. The security apparatus may include a plurality of interlocking shell portions, wherein the interlocking shell portions are shaped to, when interlocked, wrap around at least part of a perimeter of the portable electronic device, and wherein at least two shell portions comprise an aperture. The security apparatus may also include an attachment device configured to be at least partly inserted into the apertures of the at least two shell portions.

18 Claims, 9 Drawing Sheets

(56) References Cited

U.S. PATENT DOCUMENTS 4,937,860 A 6/1990 Smith
4,993,244 A 2/1991 Osman
5,154,456 A 10/1992 Moore et al.
5,169,114 A 12/1992 O'Neill
5,375,440 A 12/1994 Patterson
5,531,082 A 7/1996 Wolk et al.
5,709,110 A 1/1998 Greenfield et al.
5,836,183 A 11/1998 Derman
5,918,491 A 7/1999 Maxwell et al.
6,065,408 A * 5/2000 Tillim ..... E05G 1/005 109/25
6,081,974 A 7/2000 McDaid
6,082,156 A * 7/2000 Bin ..... G11B 23/0233 206/1.5
6,082,601 A * 7/2000 Standish ..... B60R 7/14 206/317
6,125,669 A * 10/2000 McDaid ..... E05B 73/0082 70/58
6,170,304 B1 1/2001 Ohta
6,178,089 B1 1/2001 Alfonso et al.
6,182,169 B1 1/2001 Force, Sr. et al.
6,212,921 B1 4/2001 Knighton
6,237,375 B1 5/2001 Wymer
6,321,905 B1 11/2001 Sykes
6,374,648 B1 * 4/2002 Mitsuyama ..... 70/57.1
6,418,014 B1 * 7/2002 Emerick, Jr. ..... G06F 1/16 292/148
6,427,499 B1 8/2002 Derman
6,529,381 B1 3/2003 Schoenfish
6,578,394 B2 6/2003 Yin
6,711,921 B1 3/2004 Yang
6,763,690 B2 7/2004 Galant
6,905,024 B1 * 6/2005 Cao et al. ..... 70/63
6,920,976 B2 * 7/2005 Sykes ..... E05B 73/0023 206/308.2
6,948,343 B2 * 9/2005 Williamson ..... E05B 65/48 70/158
7,028,513 B2 4/2006 Avganim
7,029,133 B2 4/2006 Challis
7,121,125 B2 10/2006 Murray, Jr. et al.
7,174,752 B2 2/2007 Galant
7,191,623 B2 3/2007 Francke
7,204,106 B2 4/2007 Merrem et al.
7,236,588 B2 6/2007 Gartrell
7,274,564 B2 9/2007 Rossini
7,299,668 B1 11/2007 Lu
7,305,858 B1 12/2007 Wu
7,315,443 B2 1/2008 Allen
7,409,915 B2 * 8/2008 Hagar ..... E05G 1/005 109/50
7,443,665 B2 * 10/2008 Allen ..... E05B 73/0082 211/8
7,499,269 B2 * 3/2009 Allen ..... E05B 73/0082 211/8
7,499,270 B2 3/2009 Allen
7,526,931 B2 * 5/2009 Burdett et al. ..... 70/57.1
7,535,799 B2 5/2009 Polany et al.
7,594,576 B2 9/2009 Chen et al.
7,609,512 B2 * 10/2009 Richardson ..... G06F 1/1626 361/679.02
7,647,796 B2 1/2010 Francke
7,724,520 B2 5/2010 Allen
7,778,023 B1 8/2010 Mohoney
7,870,766 B2 1/2011 Sedon et al.
7,907,394 B2 3/2011 Richardson et al.
7,966,851 B2 6/2011 Sedon et al.
7,983,034 B1 7/2011 Mohoney
7,997,106 B2 8/2011 Mahaffey et al.
8,001,812 B2 8/2011 Mahaffey et al.
8,191,851 B2 6/2012 Crown
8,418,514 B1 4/2013 Su
8,464,563 B2 6/2013 Perez et al.
8,783,073 B1 * 7/2014 Derman ..... 70/14
8,813,528 B2 * 8/2014 Olear et al. ..... 70/14
8,814,128 B2 * 8/2014 Trinh ..... A47F 7/024 248/187.1
8,833,117 B2 9/2014 Yang
8,869,573 B2 * 10/2014 Myers et al. ..... 70/58
8,935,943 B2 1/2015 Derman
9,163,433 B2 * 10/2015 Sedon ..... E05B 73/0082
2002/0134119 A1 9/2002 Derman
2003/0164010 A1 9/2003 Galant
2004/0177658 A1 * 9/2004 Mitchell ..... 70/58
2004/0182119 A1 * 9/2004 Lax et al. ..... 70/57.1
2005/0247584 A1 11/2005 Lu
2005/0268672 A1 * 12/2005 Fraser et al. ..... 70/57.1
2008/0072633 A1 3/2008 Samuel
2010/0079285 A1 4/2010 Fawcett et al.
2011/0072863 A1 3/2011 Mahaffey et al.
2011/0077061 A1 3/2011 Danze et al.
2011/0080137 A1 4/2011 Avganim
2011/0170257 A1 7/2011 Allen
2011/0187531 A1 8/2011 Oehl et al.
2012/0079858 A1 4/2012 Perez et al.
2012/0234055 A1 9/2012 Bland, III et al.
2014/0060125 A1 3/2014 Yang
2014/0126230 A1 * 5/2014 Harris ..... 70/58
2014/0130554 A1 5/2014 Su

OTHER PUBLICATIONS

International Search Report and Written Opinion of PCT/US2012/039418 mailed on Jul. 27, 2012, 9 pages.

Author Unknown, "iPad Enclosures: Fits all iPads," Maclocks.com, no date, retrieved from http://www.maclocks.com/index.php/ipad-enclosure-ipad-mount-ipad-kiosk.html on Jul. 5, 2012, 5 pages.

Author Unknown, "iPad2 Lock: No. 1 Selling iPad lock," Maclocks.com, no date, retrieved from http://www.maclocks.com/index.php/i-pad-lock.html on Jul. 5, 2012, 5 pages.

Author Unknown, "iPad2 Lock and Security Case Bundle—World's best selling iPad Cable Lock," Maclocks.com, no date, retrieved from http://www.maclocks.com/index.php/imac-locks/ipad-2-security-case-and-lock-bundle.html?SID=a597a3f687e6073ba8274dfecb625f56 on Jul. 5, 2012, 3 pages.

* cited by examiner

PROTECTIVE CASE FOR PHYSICALLY SECURING A PORTABLE ELECTRONIC DEVICE

CROSS-REFERENCES TO RELATED APPLICATIONS

The present application is a non-provisional patent application, claiming the benefit of priority of U.S. Provisional Application No. 61/496,983, filed on Jun. 14, 2011, which is hereby incorporated by reference in its entirety for all purposes.

BACKGROUND

Embodiments of the present invention relate to devices for inhibiting the theft of relatively small but expensive pieces of equipment, such as iPads™, iPhones™, similar mobile computing devices, tablets, laptops, or electronic devices without a security slot (e.g., a Kensington® security slot).

Electronic devices are commonly used for a variety of applications. Many electronic devices are small and valuable, making them attractive to steal. One way to deter computer theft is to provide a small, generally rectangular slot in a wall of a computer. A security apparatus with a locking head may be secured to the computer via the rectangular slot. However, many electronic devices do not include this rectangular slot. For example, iPhones™ and iPads™, each of which may retail for hundreds of dollars, do not include this rectangular slot. Owners may desire to nonetheless secure these devices to a semi-permanent or permanent fixture.

Embodiments of the invention address these and other problems, individually and collectively.

BRIEF SUMMARY

Embodiments of the invention relate to security apparatuses, as well as methods for making and using security apparatuses.

In some embodiments, a security apparatus for a portable electronic device is provided. The security apparatus may include a plurality of interlocking shell portions, wherein the interlocking shell portions are shaped to, when interlocked, wrap around at least part of a perimeter of the portable electronic device, and wherein at least two shell portions comprise an aperture. The security apparatus may also include an attachment device configured to be at least partly inserted into the apertures of the at least two shell portions. The security apparatus may further include a locking head configured to attach to the one or more attachment devices and disengage from the attachment device upon entry of a security feature, wherein engagement of the locking head with the attachment device prevents the shell portions from being removed from the portable electronic device. One of the plurality of interlocking shell portions may include a plurality of cavities and another of the plurality of interlocking shell portions may include a plurality of extensions with a size complementary to cavities. The attachment device may be spring-loaded. The interlocking shell portions may include a front shell portion configured to be positioned on a front of the portable electronic device and a back shell portion configured to be positioned on a back of the portable electronic device. The front shell portion may include a center opening for viewing a screen of the portable electronic device. The back shell portion may include a substantially solid surface.

In some embodiments, a method of securing a portable electronic device is provided. The method may include positioning the portable electronic device on a back shell portion, and positioning a front shell portion on the portable electronic device. The method may also include locking a locking feature, thereby restricting relative movement of each of the plurality of shell portions relative to each other. At least at least one of the back shell portion and the front shell portion may include an aperture. The locking feature or another locking feature complementary to the locking feature may extend through the at least one aperture so long as the locking feature remains locked. The method may further include coupling the locking feature with an immovable object prior to locking the locking feature. Locking the locking feature may include locking a locking head to an attachment device at least partly extending through the at least one aperture. The method may further include interlocking the front and back shell portions. Locking the locking feature may fix a location of the front shell portion relative to a location of the back shell portion so long as the locking feature remains locked. The method may further include interlocking the front and back shell portions. Each of the back shell portion and the front shell portion may include a aperture, and the locking feature or the another locking feature complementary to the locking feature may extend through the aperture of the back shell portion and the aperture of the front shell portion so long as the locking feature remains locked.

In some embodiments, a security apparatus for a portable electronic device is provided. The security apparatus may include a front shell portion configured to be positioned on at least part of a front side of a portable electronic device, the front side of the portable electronic device comprising a screen. The security apparatus may also include a back shell portion configured to be positioned on at least part of a back side of a portable electronic device, the back side of the portable electronic device being opposite from the front side of the portable electronic device. The security apparatus may further include a locking feature configured to lock the front shell portion to the back shell portion. The locking feature may be configured to unlock the front shell portion from the back shell portion upon entry of a security feature into the locking feature. Each of the back shell portion and the front shell portion may include an aperture. The security feature may include a key. The security apparatus may further include an attachment device configured to be received by the locking feature. At least one of the front shell portion and the back shell portion may include an attachment device, the attachment device being configured to be received by the locking feature. The front shell portion and the back shell portion may be configured to collectively form a frame around the portable electronic device.

These and other embodiments of the invention are described in further detail below.

DETAILED DESCRIPTION

Embodiments of the invention are directed to security apparatuses, methods for making and using such security apparatuses, and systems using such security apparatuses. The security apparatuses can be used to prevent or deter the theft of devices such as portable electronic devices.

Figure 1:
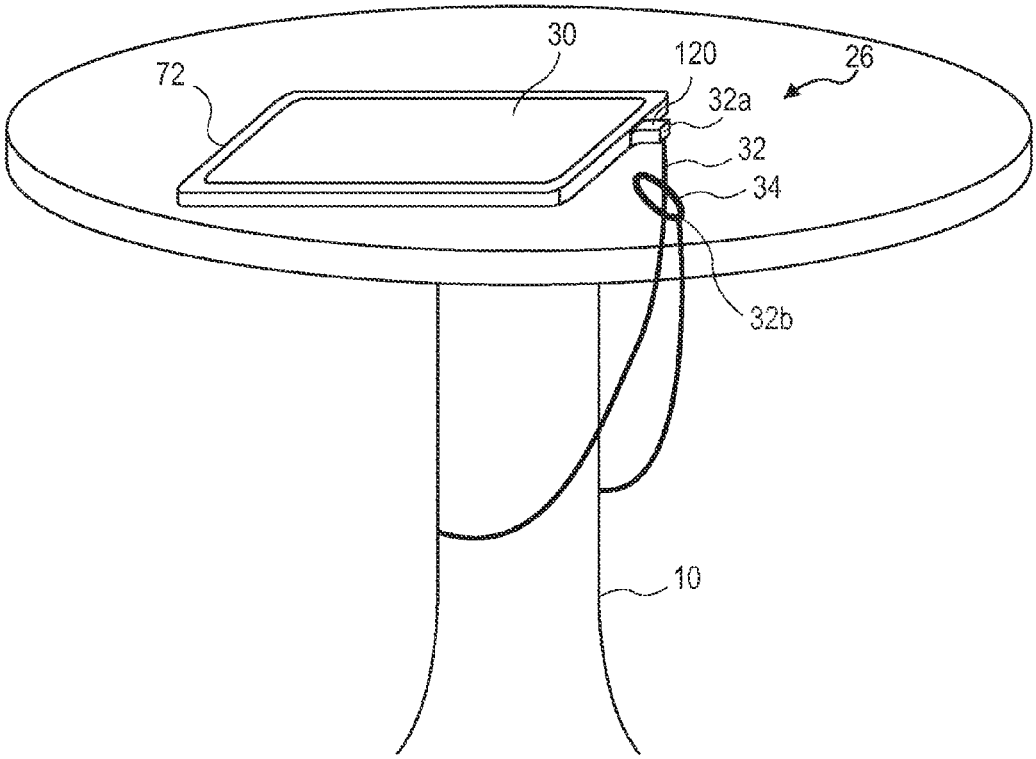
FIG. 1 shows a system according to an embodiment of the invention.

FIG. 1 shows a system comprising a portable electronic device 30 and a security apparatus 26 that is used to secure the portable electronic device 30 to an immovable object 10 such as a desk leg or the like. The security apparatus 26 includes a plurality of shell portions that are assembled by a user to at least partly encase the portable electronic device 30, thereby forming a frame 72 around the portable electronic device 30. The frame configuration may allow a user to continue to view, e.g., a screen or monitor on a front side of the portable electronic device 30 and access input components of the portable electronic device 30 even while it is secured. In other embodiments, the security apparatus may be configured to more fully or completely encase the portable electronic device 30. Such alternative configurations may be advantageous to, e.g., reduce the probability that a potential thief will spot and identify the portable electronic device 30.

The security apparatus 26 comprises a locking head 120 and a cable 32 coupled to a first end 32*a* to the locking head 120. A loop 34 is at a second end 32*b* of the cable 32. The cable 32 may comprise a strong material such as stainless steel or Kevlar™. To secure the portable electronic device 30 to the immovable object, the cable 32 may be wrapped around the immovable object and the locking head 120 may pass through the loop 34. The locking head 120 engages a portion of the frame 72, thereby coupling the cable 32 to the frame 72 and the enclosed portable electronic device 30.

Other configurations in which the security apparatus 26 (and the portable electronic device 30) may be secured to an immovable object 10 are further contemplated. FIG. 1 shows an embodiment in which the first end 32*a* of cable 32 is fixedly attached to the locking head 120 and the second end 32*b* of the cable 32 includes a loop 34 and does not directly engage with the locking head 120.

In some instances, there is no loop 34 at the second end 32*b* of the cable 32. For example, the cable 32 may be configured such that both the first end 32*a* and the second end 32*b* of the cable couple to the locking head 120. The locking head 120 may include a cable-receiving aperture. The cable 32 may then be looped around the immovable object 10 and an insertion component at the second end 32*b* may be inserted into the cable-receiving aperture, thereby locking the second end of the cable 32 to the locking head 120. Engagement of a security feature, such as a key or code, with the locking head 120 may unlock the second end of the cable 32 from the locking head 120. As another example, another locking feature (e.g, an attachment device) may be configured to receive an end of the cable.

In some instances, each of the first end 32*a* and the second end 32*b* are coupled to a locking head 120. Each locking head 120 may engage different portions of the frame (e.g., such that two locking heads 120 may engage with two bottom portions of the frame 72).

In some instances, the second end 32*b* of the cable 32 may be configured such that it may be sandwiched between the portable electronic device 30 (and potentially the frame 72) and the locking head 120. For example, the second end 32*b* may include a flat loop. The flat loop may be positioned over an engagement portion of the frame 72, and the locking head 120 may then engage with the frame, sandwiching the loop between the locking head 120 and the frame 72.

Figure 2:
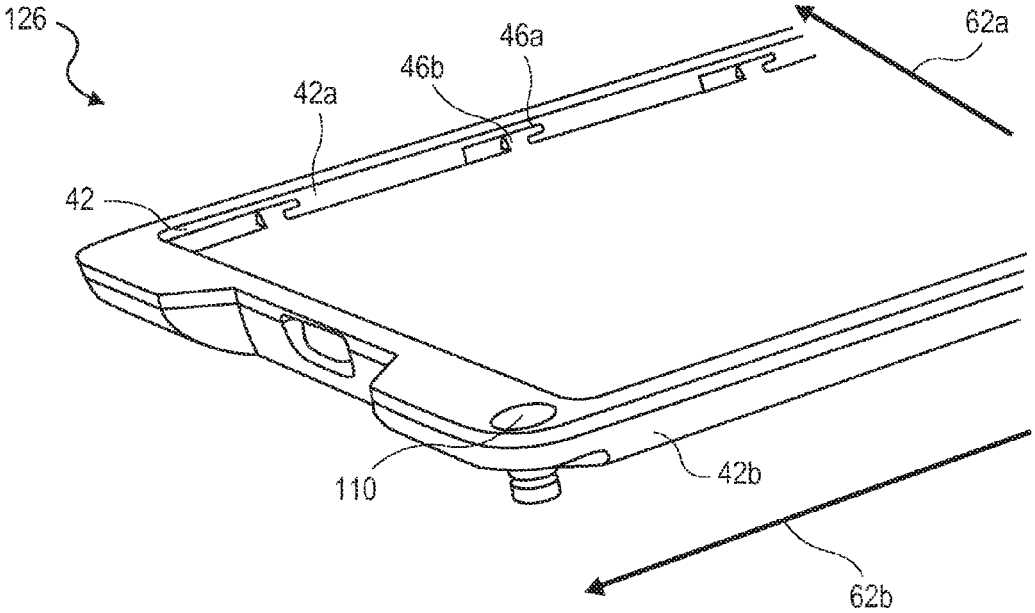
FIG. 2 shows a front perspective view including parts of a constructed security shell according to an embodiment of the invention.

FIG. 2 shows an embodiment of a security apparatus that may be used to secure a portable electronic device. As shown, the security apparatus may include interlocking protective shell portions, which may engage to form a protective shell that partly or fully encapsulates a portable electronic device. The shell may include, e.g., a front portion 42*a* and a back portion 42*b*. The security apparatus may also include an attachment device 110. The attachment device 110 may be independent from the front and back portions 42*a* and 42*b* (as shown in FIG. 2) or may be a part of one of the front and back portions 42*a* and 42*b* (e.g., a plug hinged to or extending from one of the front and back portions 42*a* and 42*b*).

The back portion 42*b* may include a surface upon which a portable electronic device 30 could be supported. The surface may be solid (as shown in FIG. 2) or may include a plurality of holes (e.g., to allow for heat dissipation). In some instances, the surface comprises a screen (e.g., a mesh). The front portion 42*a* may include a full or partial lip configured to at least partly wrap around the edges of the portable electronic device. In some instances, the front portion 42*a* does not include a center portion, e.g., such that a user may use a portable electronic device positioned within a security apparatus.

The front portion 42*a* and back portion 42*b* may be sized to, individually or collectively, at least partly wrap around a portable electronic device 30. Each portion may be characterized by a height dimension (extending along direction 62*a* in FIG. 2) and a width dimension (extending along direction 62*b* in FIG. 2). The front portion 42*a* and/or back portion 42*b* may each have one, two or three dimension (e.g., a width and height) that is slightly larger than the same type of dimension of a corresponding portable electronic device. In some instances, one dimension (e.g., a depth that is perpendicular to directions 62*a* and to 62*b*) of either of the front portion 42*a* and/or back portion 42*b* is slightly smaller than the same type of dimension of a corresponding portable electronic device, though the collective dimension of the front portion 42*a* and of the back portion 42*b* may be slightly larger than the same type of dimension of a corresponding portable electronic device. In one instance, a first dimension (e.g., a width) of the front portion 42*a* and/or back portion 42*b* is about 1-15, 4-12, or 9-11 inches. In one instance, a second dimension (e.g., a height) of the front portion 42*a* and/or back portion 42*b* is about 1-15, 2-10, or 7-9 inches. In one instance, each of the front portion 42*a* and the back portion 42*b* is about 9-10 inches wide and 7-9 inches in height.

Figure 3A:
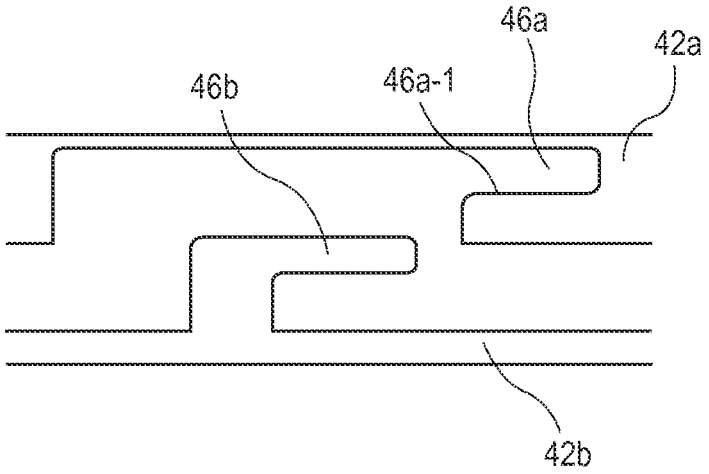
FIGS. 3*a*-3*c* show steps for interlocking security shell portions according to an embodiment of the invention.
Figure 3B:
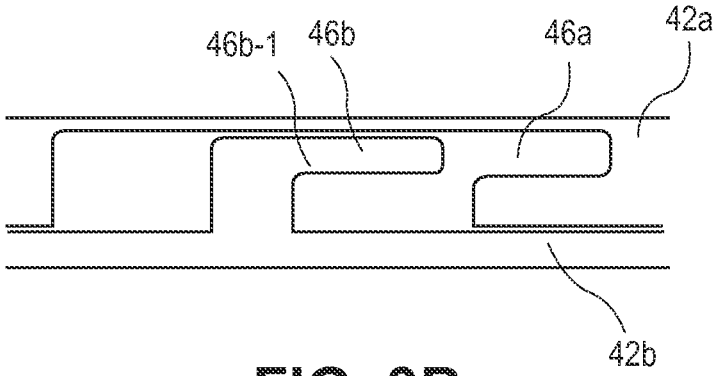
Figure 3C:
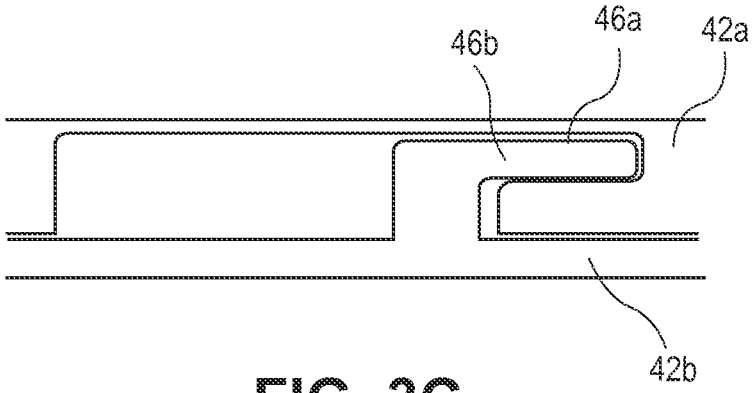

The front and back portions 42*a* and 42*b* may engage and/or interlock with each other, e.g., via one or more interlocking features 46*a* and 46*b*. FIGS. 3*a*-3*c* show how an interlocking feature 46*b* of the back portion 42*b* may engage with an interlocking feature 46*a* of the front portion 42*a*. As shown, in this embodiment, the front portion's interlocking feature 46*a* includes a cavity. The back portion's interlocking feature 46*b* includes an extension with a shape at least partly complementary to a shape of the cavity.

As shown in FIG. 3*a*, the front portion 42*a* may initially be positioned above the back portion 42*b*. As shown in FIG. 3*b*, the front and/or back portion 42*a* or 42*b* may be vertically moved, such that they are in contact with each other. As shown in FIG. 3*c*, the front and/or back portion 42*a* or 42*b* may be horizontally moved such that the back portion's interlocking feature 46*b* is inserted into the front portion's interlocking feature 46*a*. At this time, a bottom surface 46*b*-1 of the back portion's interlocking feature 46*b* may be above and/or on a bottom surface 46*a*-1 of the front portion's interlocking feature 46*a*. This interlocking may restrict vertical movement of the two portions relative to each other and may thereby confine the position of a portable electronic device framed by the portions.

Figure 4:
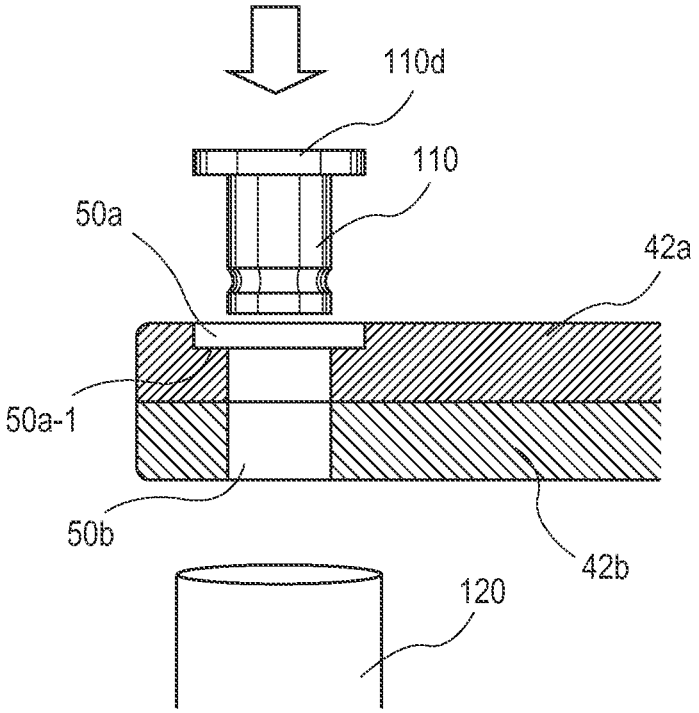
FIG. 4 shows a diagram of an attachment device being inserted into security shell portions.

After the portions 42*a* and 42*b* are interlocked, an attachment device 110 may be inserted into apertures in both of the portions, as shown in FIG. 4. The apertures may be positioned such that an aperture 50*a* in the front portion 42*a* is aligned with an aperture 50*b* in the back portion 42*b* when the portions are interlocked. In some embodiments, the apertures 50*a* and 50*b* in the two portions have a similar or same dimension (e.g., a diameter or depth) or shape (e.g., circular). In some embodiments, the apertures 50*a* and 50*b* have a different dimension (e.g., with aperture 50*a* having a diameter larger than a diameter of aperture 50*b*), which may prevent an attachment device 110 from sliding through both apertures 50. The attachment device 110 may include a shoulder element 110*d* that may rest at a surface (e.g., an internal aperture surface 50*a*-1, a front surface of front portion 42*a*, or a back surface of back portion 42*b*) to prevent the attachment device 110*d* from sliding through the apertures. In some embodiments, an aperture may vary in shape or size (e.g., in diameter) within a single portion (such as aperture 50*a* shown in FIG. 4). The apertures 50*a* and 50*b* may be shaped and sized such that a top surface of the shoulder element 110*d* of the attachment device rests above a top surface of the front portion 42*a* or such that it rests in a position flush with a top surface of the front portion 42*a*.

Figure 5:
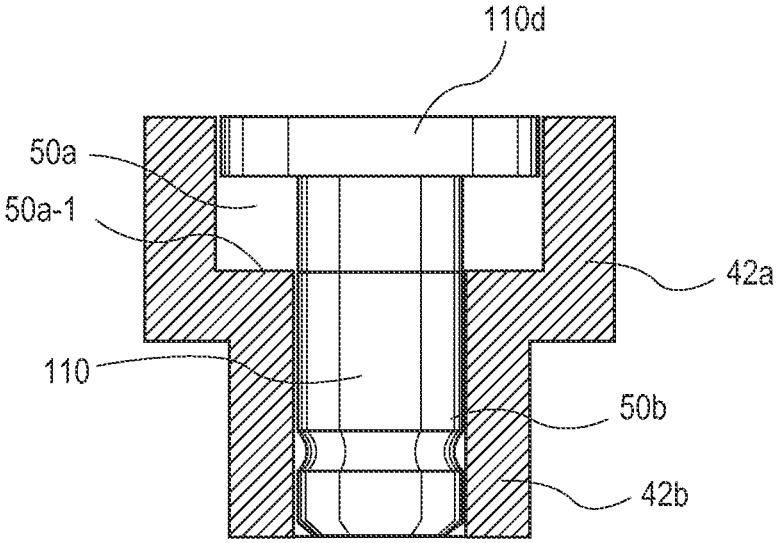
FIG. 5 shows an attachment device inserted into security shell apertures.

The attachment device 110 may be spring loaded, such that a user may press on the shoulder element 110*d* of the attachment device 110, and the attachment device 110 will spring up vertically. This configuration may allow the user to easily remove the attachment device 110 from the security apparatus. To permit the attachment device 110 to be compressed, the front portion's aperture 50*a* may include a wide portion 50*a*-1 being of a diameter wider than the shoulder element 110*d*, as illustrated in FIG. 5. This wide portion may be deeper than a depth of the shoulder element 110*d*, thereby providing space for the shoulder element 110*d* to be depressed.

Figure 6:
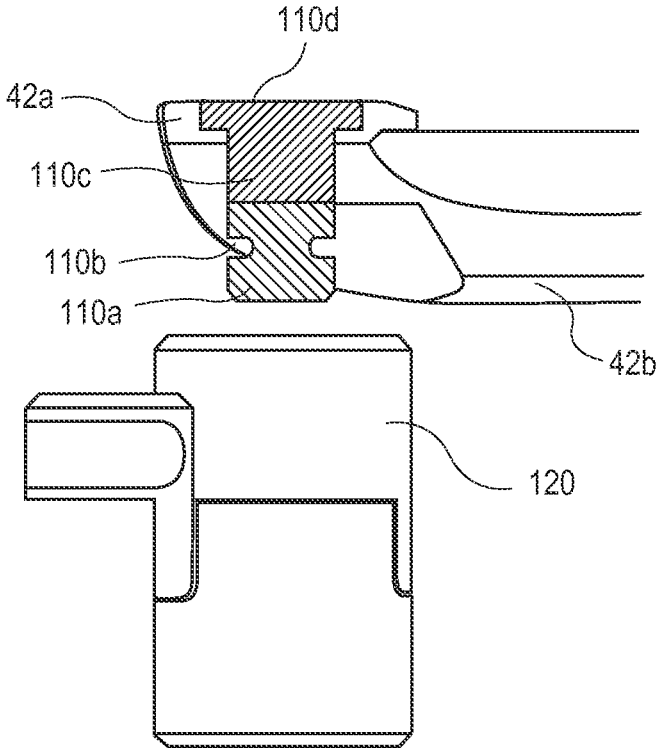
FIG. 6 shows a locking head to be engaged with an attachment device.

When the attachment device 110 is inserted into the apertures of the front and back portions 42*a* and 42*b*, a bottom end of the attachment device 110 may extend through the back portion 42*b*, as shown in FIG. 6. The bottom end may engage a locking head 120. While engaged, the front and back portions 42*a* and 42*b* may be locked to the locking head 120. As shown in FIG. 1, the locking head 120 may be coupled to a cable 32 which may be tethered to a permanent or semi-permanent object. Thus, the engagement of the attachment device 110 and the locking head 120 may restrain movement of the front and back portions 42*a* and 42*b* and any portable electronic device secured between the portions.

To permit engagement with a locking head 12, the attachment device 110 may include, e.g., a recess, such as a recess 110*b* defined by a cap 110*a* and a ring structure 110*c*. The cap 110*a* and the ring structure 110*c* may have similar diameters. In some implementations, the cap 110*a* and the ring structure 110*c* may each comprise cylinders with a substantially (axially) tapered end and a substantially flat end opposite the substantially tapered end. In other implementations, one or more ends of the cap 110*a* or the ring structure 110*c* may comprise a curved surface or other uneven shape (i.e., not flat). The lateral side wall of each of the ring structure 110*c* and the cap 110*a* may be tapered (as in a cone shape) or may comprise a straight wall.

In the embodiment illustrated in FIG. 6, the cylinders comprising the ring structure 110*c* and the cap 110*a* are facing in the same direction. That is, the direction of travel from the flat end of the cap 110*a* to the tapered end of the cap 110*a* is the same direction of travel as from the flat end of the ring structure 110*c* to the tapered end of the ring structure 110*c*. That is, the cap 110*a* and the ring structure 110*c* can be axially aligned. The recess 110*b* can be formed by the space between the tapered end of the ring structure 110*c* and the flat end of the cap 110*a*, which may be joined together (and held apart to form the recess) by a central cylinder. Thus, the recess 110*b* may be located between the cap 110*a* and the ring structure 110*c*. The tapered end of the ring structure 110*c* may taper from the width of the ring structure 110*c* to the width of the central cylinder, at which point the ring structure 110*c* may be joined to the central cylinder. In some embodiments, the cap 110*a* and the ring structure 110*c* may have approximately equal lengths, so that the recess is located approximately in the middle (along a vertical dimension) of the length of a surface of the back portion 42*b*. In some embodiments of the invention, the central cylinder may include a lateral side wall that may be tapered or may comprise a straight wall.

In certain embodiments, the cap 110*a*, the central cylinder, the ring structure 110*c*, and the shoulder element 110*d* may be structurally discrete or non-discrete. That is, the cap 110*a*, the central cylinder, the ring structure 110*c*, and the shoulder element 110*d* may together be formed of one piece of material, such as one machined metal structure with tapered portions and a recess. In another embodiment, each of the cap 110*a*, the central cylinder, the ring structure 110*c*, and the shoulder element 110*d* may be formed separately, and joined together (such as by glue, rivets, pins, etc.). In a further embodiment, the central cylinder and either the cap 110*a* or the ring structure 110*c* may comprise one continuous material, which can be joined to the third portion. For example, the ring structure 110*c* and the central cylinder can be formed of a single machined metal part, and then be joined to the cap 110*a* by any suitable process (e.g., glue, rivets, pins, etc.).

The design of the attachment device 110, as disclosed herein, contains many advantages. For example, the flat end of the cap 110*a* (i.e., the recess-facing end) can conform to the clamping structure of a locking head. In certain embodiments, the flat end of the cap 110*a* can be a substantially planar surface that is approximately 90 degrees from the lateral side wall of the cap 110*a*. This flat end of the cap 110*a* may be approximately parallel to an outer surface of the back portion 42*b*, and the flat end structure will provide a strong surface for a locking head to hold onto while securing the portable article 30. A locking head is unlikely to be able to slip or be pulled off of the cap 110*a*. Furthermore, the tapered ends of the cap 110*a* and the ring structure 110*c* may assist in guiding a locking head onto the correct position around the base while securing the portable article 30, resulting in easier locking and unlocking by a user (as described in further detail below). The lateral side wall(s) of the attachment device 110, such as the lateral sidewalls of the cap 110*a* and the ring structure 110*c*, may comprise a smooth surface, such as a polished metal surface. This smooth surface can allow a locking head to rotate about the attachment device, preventing a person from twisting the attachment device off the back portion 42*b* (i.e., forcibly unsecuring the security apparatus) by twisting the locking head. Nevertheless, attachment devices varying in design and/or operation from that described above may be used, such as those described in U.S. application Ser. No. 12/969,401, which is fully incorporated by reference.

Figure 7A:
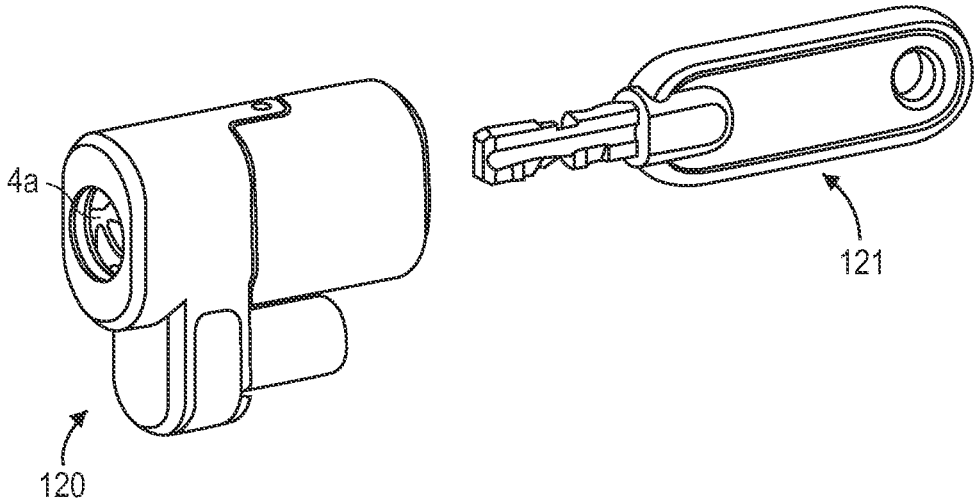
FIG. 7*a* shows a front perspective view of a key and a locking head.
Figure 7B:
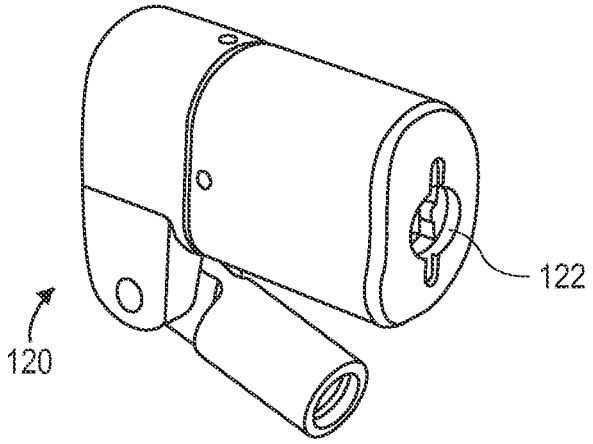
FIG. 7*b* shows a rear perspective view of a locking head.

FIG. 7*a* shows an exploded view of one exemplary locking head 120 and key 121. A front hole 4*a* in the head 120 may be configured to receive a cap 110*a* of the attachment device 110. The head 120 may include any suitable dimensions, e.g., having a length, height and/or width of about 5-50 mm. FIG. 7*b* shows a rear perspective view of the head 120. A keyhole 122 is at a rear section of the head 120. Locking heads and/or keys varying in design and/or operation from that described above may be used, such as those described in U.S. application Ser. No. 12/969,401, which is fully incorporated by reference.

Figure 8:
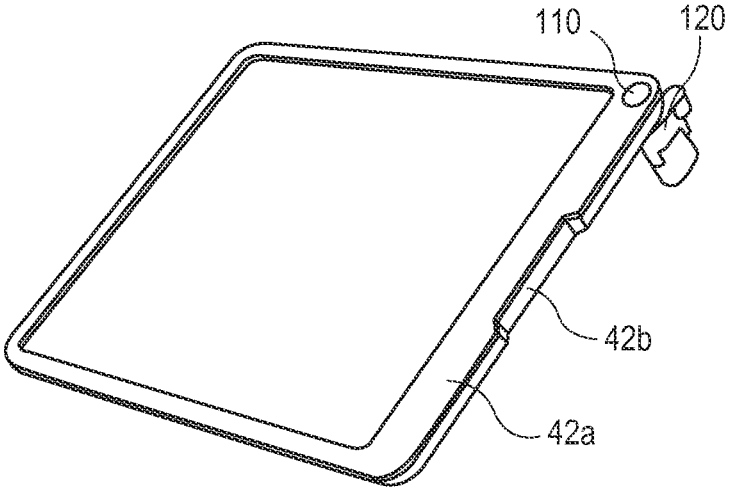
FIG. 8 shows a locked security shell.

FIG. 8 shows a front view of a locked and configured security apparatus according to an embodiment of the invention. As shown, the front and back portions 42*a* and 42*b* are interlocked, the attachment device 110 is inserted into apertures of the portions, and the locking head 120 is engaged with the attachment device 110. A portable electronic device may be positioned between the front and back portions 42*a* and 42*b*, such that the front portion 42*a* wraps around the front of the portable electronic device, and back portion 42*b* supports the back of the portable electronic device. The combined shell portions may form a full or partial frame around the portable electronic device. Thus, when the shell portions are locked in this position (e.g., by interlocking the shell portions, inserting an attachment device through apertures of the shell portions and locking the attachment device to a locking head), a third party may be prevented from separating the portable electronic device from the shell and from the locking head 120. A width of the created frame may be, e.g., about 0.5-5 cm. Thus, a user of the portable electronic device may still be able to use the portable electronic device while the security apparatus is in operation due to a center opening in the front portion 42*a*. The shell portions may be configured to cover all of the back of the portable electronic device (e.g., as shown in FIG. 2) or to cover distinct regions (e.g., corresponding to the portable electronic device's motherboard) to prevent third parties from stealing valuable parts of the portable electronic device from the back. The locking head 120 may be attached to a cable 32, which may be looped around or attached to a semi-permanent or permanent structure, as shown, e.g., in FIG. 1. In this manner, a portable electronic device 30 may be securely coupled to a fixed location.

Many variations on the above-described embodiments are contemplated. For example, FIGS. 2 and 4 illustrate an embodiment in which engaged front and back portions 42*a* and 42*b* are locked together by locking together two complementary locking features: an attachment device 110 (which is inserted through one or more apertures of the front and back portions 42*a* and 42*b*) and a locking head 120. The front and back portions 42*a* and 42*b* may be locked together using other techniques and/or other locking features. For example, a security apparatus may include only a single locking feature or a plurality of non-complementary locking features.

In one embodiment, a single locking feature is inserted through an aperture in the front portion 42*a* and an aperture in the back portion 42*b*, moved (e.g., rotated, expanded and/or translationally moved) and locked. The movement and subsequent locking of the locking feature may prevent a thief from pulling the locking feature back through the apertures to thereby decouple a frame formed by the back and front portions 42*a* and 42*b* (that at least partly encloses a portable electronic device) from the locking feature. Because the locking feature may be coupled to a cable looped around an immovable object, this design may prevent the thief from stealing the portable electronic device.

The locking feature may include, e.g., an attachment mechanism and/or a configuration disclosed in U.S. Pat. No. 7,121,125, which is hereby incorporated by reference in its entirety. In one embodiment, the locking feature comprises a T-bar lock. One or more apertures may be sized and shaped such that it may receive a crossmember of the T-bar only when the crossmember is in a particular orientation (e.g., horizontally and not vertically). The T-bar may be appropriately oriented and the crossmember inserted through aperture(s) formed in one or more shell portions. The T-bar may then be rotated and locked in the rotated position. Thus, it may not be possible to pull the crossmember of the T-bar back through the aperture(s) without first unlocking the T-bar lock. Further, because the crossmember extends at least partly through apertures in two frame portions, the two frame portions are locked together.

The locking feature (e.g., T-bar lock) may be connected to a cable that may be wrapped around a semi-permanent or permanent fixture. Entry of a security feature (e.g., a key) into the locking feature may again allow for the locking feature to be pulled back through the aperture and thereby allow the portable electronic device 30 to be removed from the frame portions.

Figure 9:
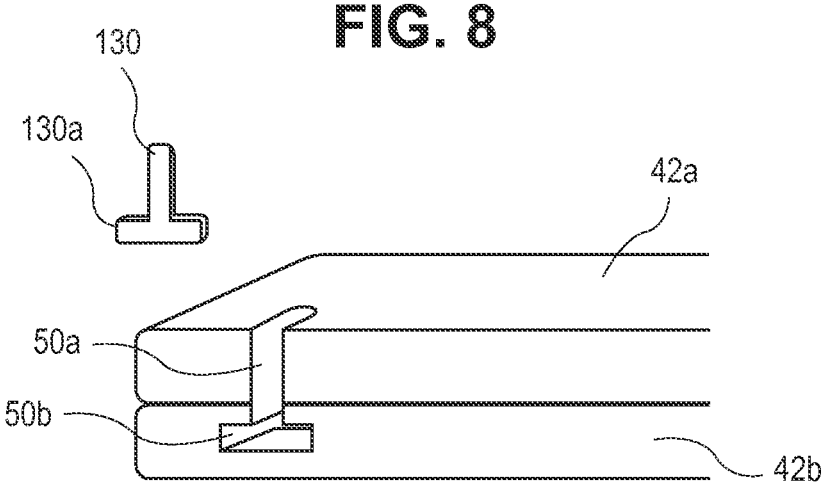
FIG. 9 shows a perspective of a T-bar lock and a cross-sectional perspective view including parts of a constructed security shell according to an embodiment of the invention.

FIG. 9 shows a cross-section of a portion of a security shell with elongated and slit-like apertures 50*a* and 50*b*. In this instance a locking feature includes a T-bar lock 130 (which may be coupled to a cable). A crossmember 130*a* of the T-bar lock may be aligned with and inserted at least partly through the apertures. The crossmember may then be rotated, and the T-bar lock may be locked to prevent reverse rotation. A thief may then be unable to pull the crossmember back through the aperture. In FIG. 9, aperture 50*a* extends fully through front portion 42*a*, while aperture 50*b* does not extend fully through back portion 42*b*. Instead aperture 50*b* includes a frontwards slit-like portion and a larger backwards portion sized to allow rotation of the crossmember 130*a*. In one instance, aperture 50*b* extends fully through back portion 42*b*.

Figure 10A:
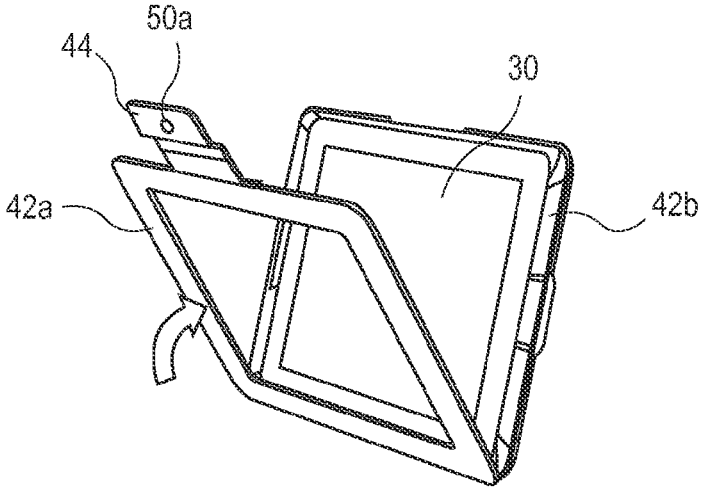
FIGS. 10*a*-10*c* show steps for securing a portable electronic device between security shell portions according to an embodiment of the invention.
Figure 10B:
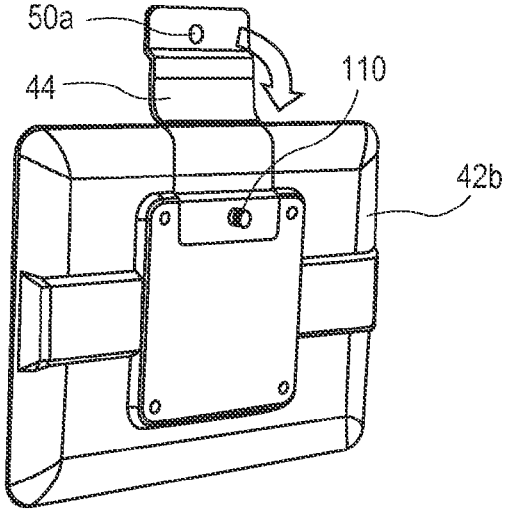
Figure 10C:
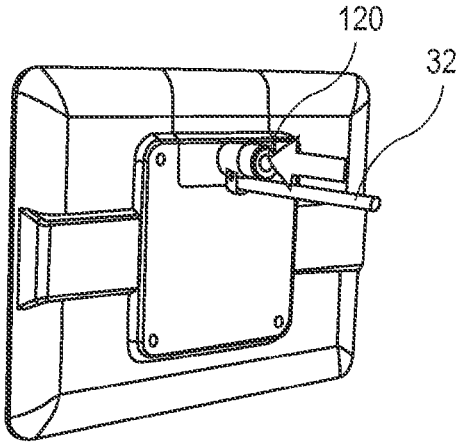

FIGS. 10*a*-10*c* show exemplary operational modes of a security apparatus. In this embodiment, the front portion 42*a* is coupled to the back portion 42*b* via a bottom hinge. Front portion 42*a* includes a connecting portion 44, which is hingedly coupled to a primary front component of the front portion 42*a*. As shown in FIG. 10*a*, a portable electronic device 30 may be positioned between the back portion 42*b* and the front portion 42*a*. The front and/or back portion may be folded towards the other portion to create a frame around the portable electronic device 30. As shown in FIG. 10*b*, the connecting portion 44 may then be folded over the back portion 42*b*. The connecting portion 44 includes an aperture 50*a* which is sized and positioned to receive an attachment device 110 integrated into the back portion 50*b*. The attachment device 110 then extends through the aperture 50*a*, and a locking head 120 may be locked to the attachment device. The relative positions of the front and back portions 42*a* and 42*b* are then fixed, thereby locking the enclosed portable electronic device 30 to the portions and the locking head 120. The locking head 120 is coupled to a cable 32, which may be wrapped around an immovable object. Thus, the portable electronic device 30 may be locked to the immovable object.

Figure 11A:
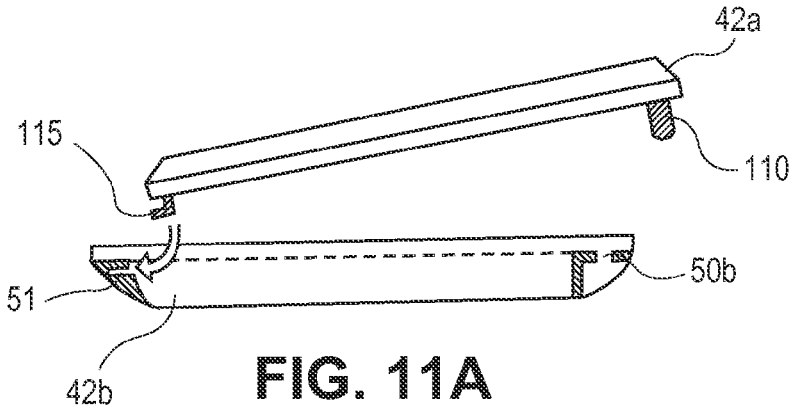
FIGS. 11*a*-11*e* show steps for securing a portable electronic device between security shell portions according to an embodiment of the invention.
Figure 11B:
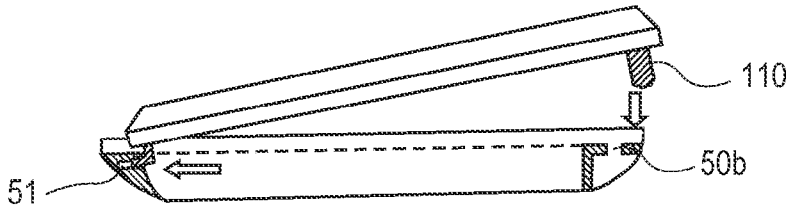
Figure 11C:
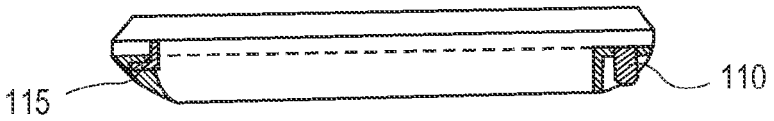
Figure 11D:
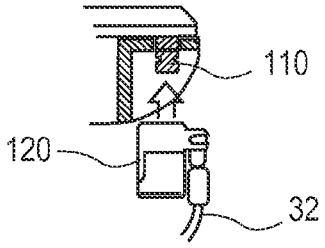
Figure 11E:
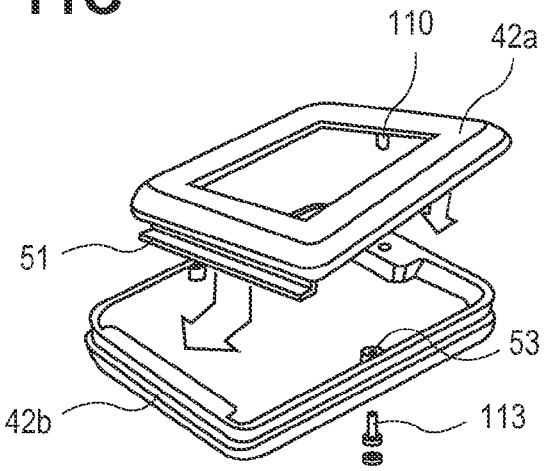

FIGS. 11*a*-11*e* show exemplary operational modes of a security apparatus. In this embodiment, the front portion 42*a* includes a tab 115, and the back portion 42*b* includes a complementary slot 51. The tab 115 is positioned near a bottom of the front portion 42*a*, and the slot 51 is positioned near a bottom of the back portion 42*b*. A portable electronic device may be positioned in or on the back portion 42*b*. The tab 115 may then be slid into the slot 51 to join the bottoms of the front portion 42*a* and the back portion 42*b*, as shown in FIG. 11*a*. An attachment device 110 is located near a top of the front portion 42*a*, and a complementary aperture 50*b* is located near a top of the back portion 42*b*. One or both of the tops of the front portion 42*a* and back portion 42*b* may be moved towards each other, and the attachment device 110 may extend through the aperture 50*b*, as shown in FIGS. 11*b*-*c*. Part of the attachment device 110 remains accessible, as shown in FIG. 11*c*. Therefore, a locking head 120 may lock to the attachment device 110, as shown in FIG. 11*d*. The relative positions of the front and back portions 42*a* and 42*b* are then fixed, thereby locking the enclosed portable electronic device to the portions and the locking head 120. The locking head 120 is coupled to a cable 32, which may be wrapped around an immovable object. Thus, the portable electronic device may be locked to the immovable object. As shown in FIG. 11*e*, the security apparatus may include additional securing elements. For example, front portion 42*a* and back portion 42*b* may include one or more holes 53 sizes to receive a screw 113 or additional locking feature. The locking feature may be inserted through the one or more holes 53 (e.g., through holes aligned in the front and back portions 42*a* and 42*b*) to further secure a connection between the front and back portions 42*a* and 42*b*.

In some embodiments, a security apparatus may include more than one of the above-described embodiments. For example, the embodiment shown in FIG. 2 may also include apertures to receive a T-bar lock, as illustrated in FIG. 9. A user could then choose to engage an attachment device 110 extending through an aperture with a locking head and/or to insert another attachment mechanism (e.g., a T-bar lock) through aligned apertures.

A security apparatus may include additional features. For example, a constructed security apparatus may include a hinged stand support, such that a user may prop an enclosed portable electronic device at an angle. In one instance, the hinged stand support is included on one of the front or back portions. In one instance, a stand support is hingedly connected to a primary component of the back portion 42*b*.

Front portion 42*a* and/or back portion 42*b* may comprise, e.g., a plastic, metal, or microfiber material. A material may one that would protect a portable electronic device housed by the portions, provide traction on an outer surface, and/or allow the portable electronic device to easily slide along an inner surface.

Figure 12:
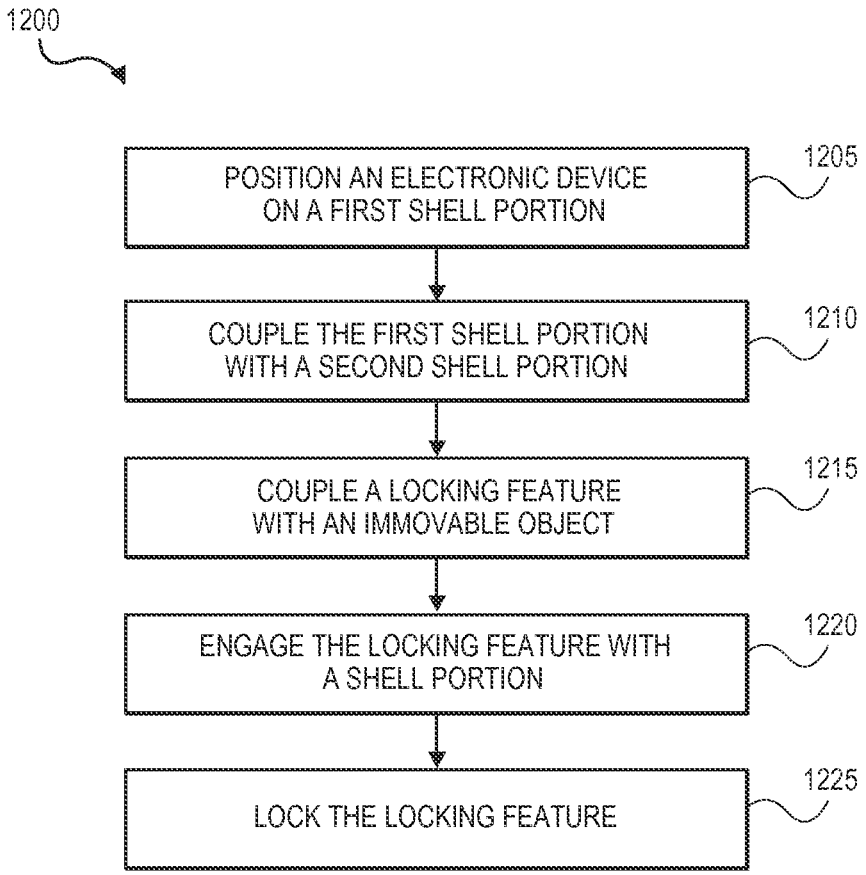
FIG. 12 shows a flowchart illustrating a method of using a security apparatus according to an embodiment of the invention.

FIG. 12 shows a flowchart illustrating a method 1200 of using a security apparatus according to an embodiment of the invention. At block 1205, a portable electronic device is positioned on or over a first shell portion. For example, a portable electronic device 30 may be positioned on a back portion 42*b*. The first shell portion may be shaped such that it at least partly wraps around or extends beyond the portable electronic device subsequent to the positioning.

At block 1210, the first shell portion is coupled with a second shell portion. For example, the back portion 42*b* may be coupled with a front portion 42*a*. The coupling may involve one step or multiple steps. The coupling may include, e.g., interlocking the portions (e.g., as illustrated in FIGS. 3*a*-3*c*), inserting an attachment device coupled to one portion through an aperture of another (e.g., as illustrated in FIGS. 11*b*-11*c*), inserting a tab into a slot (e.g., as illustrated in FIGS. 11*a*-11*b*), inserting a locking feature through apertures in both portions (e.g., as illustrated in FIG. 4 or FIG. 9), etc. The second shell portion may be shaped such that it partly wraps around or extends beyond the portable electronic device subsequent to the coupling.

At block 1215, a locking feature (e.g., a locking head, attachment mechanism or T-bar) is coupled with an immovable object. For example, a cable 32, U-bar, etc. that is coupled to a locking feature (e.g., a locking head 120) may be wrapped around an immovable object 10. In some instances, a cable 32 is wrapped around an immovable object 10, and one end of the cable 32 (e.g., the end attached to the locking feature) is inserted through a loop 34 at the other end of the cable 32.

At block 1220, the locking feature is engaged with a shell portion. For example, a locking head 120 may engage with (e.g., and lock to) an attachment device 110. The attachment device 110 may be integrated into a shell portion or separate from the shell portions. The attachment device may, e.g., extend through an aperture in the shell portion. As another example, a crossmember on a T-bar lock may extend through an aperture in each of one or more frame portions, may rotate, and then may lock in the rotated position (thereby preventing reverse removal through the aperture(s)). In some embodiments, engagement of the locking feature with the shell portion sandwiches an intermediate component between the locking feature and the shell portion. For example, a shell portion (e.g., the connecting portion 44) may include an aperture 50*a* that may be positioned over the attachment device 110 coupled to another frame portion (e.g., the back shell portion 42*b*) prior to engaging an attachment device 110 with a locking head 120. The engagement of the locking head 120 with the attachment device 110 may then restrict the movement of the front and back portions 42*a* and 42*b* relative to each other. Thus, a portable electronic device positioned between the portions may be locked to the locking head 120 and the immovable object.

Figure 13:
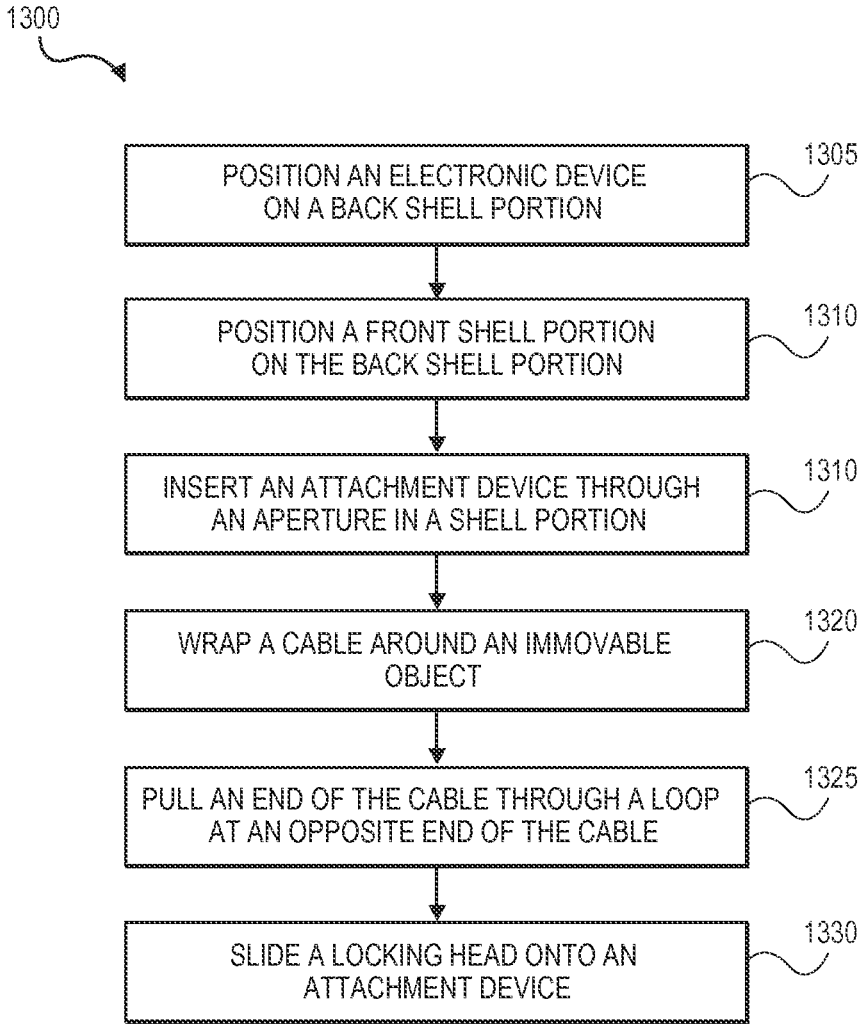
FIG. 13 shows a flowchart illustrating a method of using a security apparatus according to an embodiment of the invention.

FIG. 13 shows a flowchart illustrating a method 1300 of using a security apparatus according to an embodiment of the invention. At block 1305, a portable electronic device 30 is positioned on a back shell portion 42*b*. At block 1310, a front shell portion 42*b* is positioned on or over the back shell portion 42*a*. At this point, the front and back portions 42*a* and 42*b* may form a frame 72, partial enclosure or complete enclosure around the portable electronic device.

In some instances, the front and back portions 42*a* and 42*b* are engaged with each other. For example, the front and back portions 42*a* and 42*b* may interlock using complementary interlocking features on the portions.

At block 1315, an attachment device is inserted through an aperture in a shell portion. The attachment device may be independent from the shell portions, coupled to a shell portion or part of a shell portion. In some instances, an attachment device is inserted through an aperture in the front portion and an aperture in the back portion. For example, an independent attachment device 110 may be inserted through an aperture 50*a* in the front portion 42*a* and an aperture 50*b* in the back portion.

At block 1320, a cable 32 is wrapped around an immovable object 10, such as a desk leg. The immovable object 10 need not literally be immovable, but may be sufficiently stationary, heavy or ground-attached to make it difficult to slide a wrapped cable 32 off of the object 10.

At block 1325, a first end 32*a* of the cable 32 is pulled through a loop 34 at a second opposite end 32*b* of the cable 32. Thus, a larger loop is formed in the cable which loops around the immovable object 10. The first end 32*a* may be coupled to a locking head 120.

At block 1330, a locking head 120 coupled to the first end 32*a* of the cable 32 may be slid onto the attachment device 110. Upon application of sufficient pressure on the locking head 120, the locking head 120 may lock onto the attachment device 110. The locked locking head 120 and attachment device 110 may prevent the front portion 42*a* from separating from the back portion 42*b* and may couple the portions and the portable electronic device positioned between the portions to the immovable object 10.

The above description is illustrative and is not restrictive. Many variations of the invention will become apparent to those skilled in the art upon review of the disclosure. The scope of the invention should, therefore, be determined not with reference to the above description, but instead should be determined with reference to the pending claims along with their full scope or equivalents.

One or more features from any embodiment may be combined with one or more features of any other embodiment without departing from the scope of the invention. Where approximate or "about" is described for measurements, embodiments herein also contemplate the exact measurement. Where a shape is disclosed, such as a cylinder, embodiments herein contemplate other suitable shapes, such as multi-sided blocks (octagonal structures, decagonal structures, etc.), other rectangular structures, etc. In certain implementations, structures with multiple sides approaching the shape of cylinders, as well as substantially cylindrical shapes (e.g., a cylinder with a flat sidewall portion) may be considered cylinders as described herein, unless otherwise specified.

A recitation of "a", "an" or "the" is intended to mean "one or more" unless specifically indicated to the contrary.

What is claimed is:

1. A security apparatus for a portable electronic device, the security apparatus comprising:

a plurality of interlocking shell portions including interlocking features that engage each other to inhibit separation of the plurality of interlocking shell portions, wherein the interlocking shell portions are shaped to, when interlocked, wrap around at least part of a perimeter of the portable electronic device, and wherein at least two shell portions comprise an aperture;

an attachment device configured to be at least partly inserted into the apertures of the at least two shell portions; and a locking head selectively engaging the attachment device to inhibit removal of the plurality of interlocking shell portions from the portable electronic device, the locking head being removable from the attachment device to allow separation of the plurality of interlocking shell portions.

2. The security apparatus of claim 1 wherein the locking head disengages from the attachment device upon entry of a security feature.

3. The security apparatus of claim 1 wherein one of the plurality of interlocking shell portions comprises a plurality of cavities and another of the plurality of interlocking shell portions comprises a plurality of extensions with a size complementary to cavities.

4. The security apparatus of claim 1 wherein the attachment device is integrated into one of the plurality of interlocking shell portions.

5. The security apparatus of claim 1 wherein the interlocking shell portions include a front shell portion configured to be positioned on a front of the portable electronic device and a back shell portion configured to be positioned on a back of the portable electronic device.

6. The security apparatus of claim 5 wherein the front shell portion comprises a center opening for viewing a screen of the portable electronic device.

7. The security apparatus of claim 5 wherein the back shell portion comprises a substantially solid surface.

8. A method of securing a portable electronic device, the method comprising:

positioning the portable electronic device on a back shell portion, the back shell portion including a substantially solid surface that covers an entire back side of the portable electronic device;

positioning a front shell portion on the portable electronic device, the front shell portion defining an opening for touching a screen on a front side of the portable electronic device;

locking a locking feature, thereby restricting relative movement of each of the plurality of shell portions relative to each other, wherein at least one of the back shell portion and the front shell portion comprises an aperture, and wherein the locking feature or another locking feature complementary to the locking feature extends through the at least one aperture so long as the locking feature remains locked; and securing the locking feature to an immovable object prior to locking the locking feature, thereby inhibiting separation of the portable electronic device from the immovable object, wherein securing the locking feature includes securing the locking feature to the immovable object with a cable.

9. The method of claim 8 further comprising interlocking the front and back shell portions.

10. The method of claim 8 wherein locking the locking feature fixes a location of the front shell portion relative to a location of the back shell portion so long as the locking feature remains locked.

11. The method of claim 8 further comprising interlocking the front and back shell portions.

12. The method of claim 8 wherein each of the back shell portion and the front shell portion comprise a aperture, and wherein the locking feature or the another locking feature complementary to the locking feature extends through the aperture of the back shell portion and the aperture of the front shell portion so long as the locking feature remains locked.

13. A method of securing a portable electronic device, the method comprising:

positioning the portable electronic device on a back shell portion, the back shell portion including a substantially solid surface that covers an entire back side of the portable electronic device;

positioning a front shell portion on the portable electronic device, the front shell portion defining an opening for touching a screen on a front side of the portable electronic device;

locking a locking feature, thereby restricting relative movement of each of the plurality of shell portions relative to each other, wherein at least one of the back shell portion and the front shell portion comprises an aperture, and wherein the locking feature or another locking feature complementary to the locking feature extends through the at least one aperture so long as the locking feature remains locked; and securing the locking feature to an immovable object prior to locking the locking feature, thereby inhibiting separation of the portable electronic device from the immovable object, wherein locking the locking feature comprises locking a locking head to an attachment device at least partly extending through the at least one aperture.

14. A security apparatus for a portable electronic device, the security apparatus comprising:

a front shell portion configured to be positioned on at least part of a front side of a portable electronic device, the front side of the portable electronic device comprising a screen, the front shell portion defining an opening for touching the screen;

a back shell portion configured to be positioned on a back side of a portable electronic device, the back side of the portable electronic device being opposite from the front side of the portable electronic device, the back shell portion including a substantially solid surface that covers the entire back side of the portable electronic device; and a locking feature configured to lock the front shell portion to the back shell portion, wherein the locking feature is configured to unlock the front shell portion from the back shell portion upon entry of a security feature into the locking feature, wherein the security feature comprises a key.

15. The security apparatus of claim 14 wherein each of the back shell portion and the front shell portion comprise an aperture.

16. The security apparatus of claim 14 further comprising an attachment device configured to be received by the locking feature.

17. The security apparatus of claim 14 wherein at least one of the front shell portion and the back shell portion comprises an attachment device, the attachment device being configured to be received by the locking feature.

18. The security apparatus of claim 14 wherein the front shell portion and the back shell portion are configured to collectively form a frame around the portable electronic device.

* * * * *